United States Patent [19]

Marks

[11] Patent Number: 4,696,174

[45] Date of Patent: Sep. 29, 1987

[54] REVERSIBLE MORTISE LOCKSET

[76] Inventor: George R. Marks, 19 The Hemlocks, Roslyn Estates, N.Y. 11576

[21] Appl. No.: 793,140

[22] Filed: Oct. 31, 1985

[51] Int. Cl.[4] ..... E05B 9/08

[52] U.S. Cl. ..... 70/451; 70/461; 70/462

[58] Field of Search ..... 70/451, 461, 462, 134, 70/DIG. 31; 292/DIG. 53, DIG. 60, DIG. 64; 49/63, 67

[56] References Cited

U.S. PATENT DOCUMENTS

| | | | |
|---|---|---|---|
| 1,449,394 | 3/1923 | Garner | 70/462 |
| 1,469,829 | 10/1923 | Teich | 70/451 |
| 2,263,772 | 11/1941 | Gold et al. | 70/451 |
| 2,664,181 | 12/1953 | Boughton | 70/451 |
| 2,803,481 | 8/1957 | Williams et al. | 70/462 |
| 3,039,291 | 6/1962 | Dusing et al. | 70/451 |
| 3,177,924 | 4/1965 | McPhail | 49/63 X |
| 3,211,486 | 10/1965 | Crandell | 70/451 |
| 3,452,564 | 7/1969 | Hallgren | 70/451 |
| 3,503,234 | 3/1970 | Schultz | 70/451 |
| 3,513,674 | 5/1970 | Rutherford | 70/452 X |
| 3,732,712 | 5/1973 | Miller | 70/461 |
| 3,832,805 | 9/1974 | Stevens | 49/67 X |
| 3,999,789 | 12/1976 | Maurits et al. | 70/462 |
| 4,080,813 | 3/1978 | McKann | 70/451 |
| 4,129,019 | 12/1978 | Urdal | 70/462 |
| 4,139,999 | 2/1979 | Allenbaugh | 70/461 |
| 4,272,974 | 6/1981 | Hennessy | 70/451 |

FOREIGN PATENT DOCUMENTS

| | | | |
|---|---|---|---|
| 7607456 | 10/1976 | Netherlands | 70/462 |

*Primary Examiner*—Robert L. Wolfe
*Assistant Examiner*—Suzanne L. Dino
*Attorney, Agent, or Firm*—Alan H. Levine

[57] ABSTRACT

A reversible mortise lockset for use with an ornamental metal security storm door furnished with a lock box, each of the two opposed vertical walls of the lock box having two vertically aligned holes of equal diameter. The lockset includes a mortise lock which can be inserted into the lock box in either of two alternative orientations, namely, the lock cylinder hole of the mortise lock in registry with the upper holes in the lock box or the lock cylinder hole of the mortise lock in registry with the lower holes in the lock box. In either orientation, the door knob spindle hole and a through bolt hole of the mortise lock are exposed through the lock box holes not in registry with the lock cylinder hole. A pair of plates are provided for mounting on the exterior surfaces of the lock box walls, each plate having a door knob and spindle near one end and a lock cylinder hole near the other end. One of the plates has a single mounting post projecting parallel to the door knob spindle. Regardless of which orientation the mortise lock assumes in the lock box, each plate can be mounted with its lock cylinder hole in registry with the lock cylinder hole in the mortise lock and its door know spindle and mounting post located in the door knob spindle hole and through bolt hole of the mortise lock.

7 Claims, 4 Drawing Figures

REVERSIBLE MORTISE LOCKSET

This invention relates to mortise locksets, and more particularly to such locksets used with security storm doors.

A security storm door is, essentially, a heavy duty storm door. It is made of interconnected metal bars and decorative wrought iron. At the edge of the door opposite the hinged edge, the door is provided with a metal lock box adapted to accommodate a mortise lock. The lock box, which forms a permanent part of the security door, includes two vertical walls flush with the inner and outer surfaces of the door, respectively, and an open front end flush with the edge of the door opposite the hinged edge. A mortise lock can be inserted into the lock box through its open front end.

The lock boxes are generally of two types. One type has a relatively large hole in each vertical wall, the two holes being horizontally aligned. Each vertical wall of the box also includes three smaller holes. When a mortise lock is inserted into the lock box, the lock cylinder hole in the mortise lock becomes aligned with the two larger holes in the lock box, so that lock cylinders can be inserted through the holes in the lock box into the mortise lock. In addition, the three smaller holes in each lock box wall are aligned with three similar holes in the mortise lock. The spindles of the inner and outer door knobs can be inserted through one of those holes into the mortise lock. A rosette surrounding each door knob carries two mounting posts which fit through the other two holes in the lock box wall and the mortise lock. Bolts are inserted through the corresponding holes in the other lock box wall and threaded into the mounting posts. In this way, the rosettes and door knobs are "through-bolted" to the lock box and mortise lock, which provides a very secure mounting for the door knobs.

A problem presented by the type of mounting described above is that the location of the door knobs cannot be changed. In other words, if the larger, cylinder-accommodating hole in each lock box wall is located above the holes which accommodate the door knob spindles and mounting posts, the door knobs must always be located below the lock cylinders. However, it sometimes happens that the inner door knob of the security storm door interferes with the outer door knob of the main door which is to be protected by the storm door. This interference can prevent closing of the storm door, and is obviously unacceptable. However, there is no way that the positions of the door knobs and lock cylinders can be reversed so as to rectify this interference.

The second type of lock box is furnished with two cylinder-size holes in each vertical wall, each of those holes being horizontally aligned with the corresponding hole in the other wall. When a mortise lock is inserted into this type of box, the cylinder-receiving hole in the mortise lock registers with one of the holes in each box wall. In addition, the door knob spindle hole and only one of the two mounting post holes in the mortise lock register with the other hole in each box wall. Thus, if the security door knob interferes with the main door knob when the mortise lock is inserted in one orientation, the mortise lock can be removed and reversed, i.e., rotated 180° about a horizontal axis, and reinserted into the lock box. It will be appreciated that the cylinder hole in the mortise lock will be aligned with one or the other hole in each box wall depending on the orientation of the mortise lock in the box.

However, a disadvantage of this arrangement is that only one of the two mounting post holes is exposed through a hole in the lock box, regardless of which orientation the mortise lock takes in the lock box. Consequently, the installer must drill a second hole through each vertical wall of the lock box so that both mounting posts of the rosette can pass through to the mortise lock. These additional holes must be drilled accurately to insure a secure installation, and hence the quality of the installation depends to a great degree on the skill of the installer.

It is an object of the present invention to provide a mortise lock set arrangement, for use with the latter type of lock box described above, which offers reversability of the door knob location as well as "through-bolting" of the door knobs, while at the same time avoiding any need for additional drilling of the lock box.

It is another object of the invention to provide such a mortise lock set arrangement wherein the lock cylinders are utilized to help mount the door knobs on the security storm door.

Additional objectives and features of the invention will be apparent from the following description, in which reference is made to the accompanying drawings.

Figure 1:
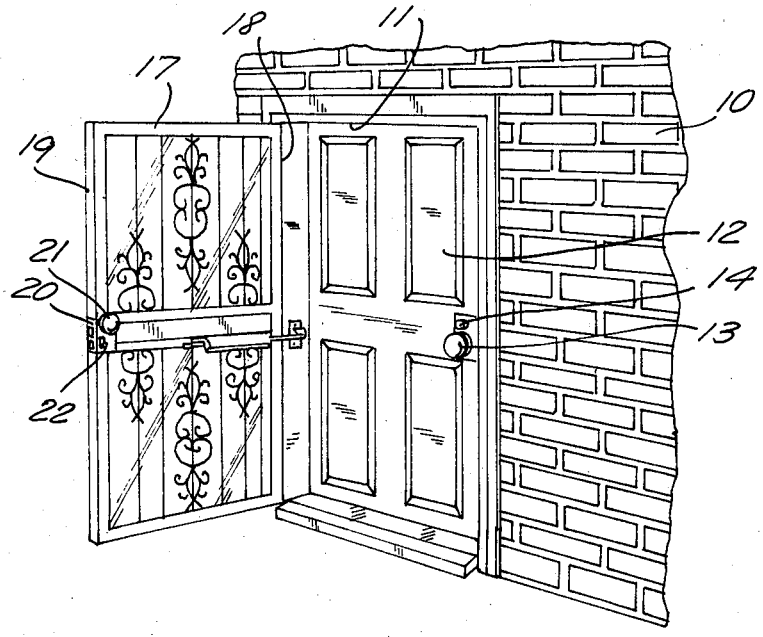
FIG. 1 is a perspective view of the doorway of a building provided with a main door and a security storm door.

Referring to FIG. 1, a wall 10 of a building is shown having a doorway 11. A main door 12 closes the doorway 11, the main door having an outer door knob 13 and a lock cylinder 14 of conventional design.

An ornamental metal security storm door 17 is hinged to the doorway 11, along its edge 18, outwardly of the main door 12. Near the center of its edge 19, opposite the hinged edge 18, storm door 17 is furnished with a lock box 20, shown in greater detail in FIG. 2. In a manner to be described in detail below, a mortise lockset is assembled with lock box 20, the lockset including an inner door knob 21 and lock cylinder 22, which can be seen in FIG. 1.

Figure 2:
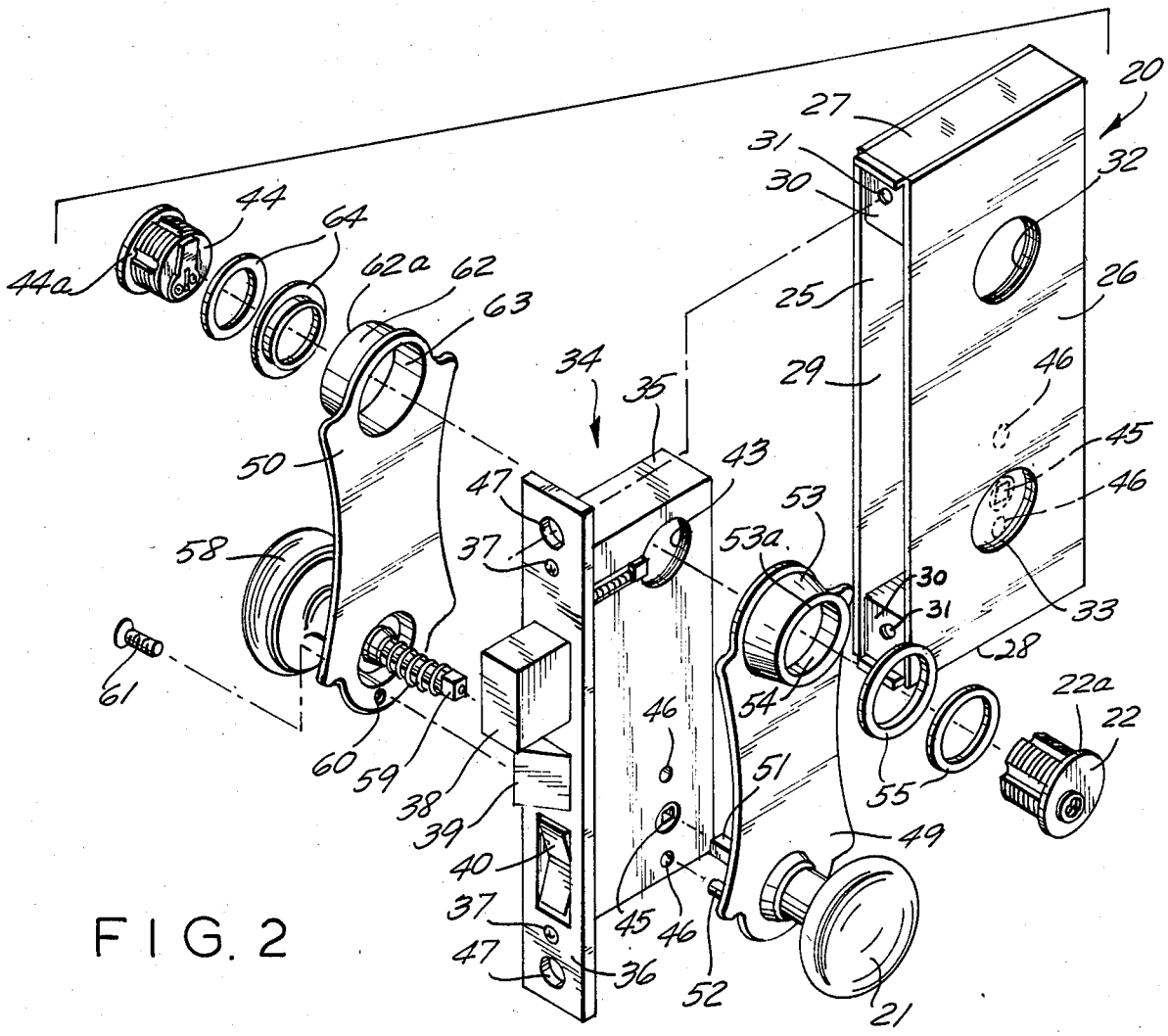
FIG. 2 is an exploded perspective view of the lock box of the security storm door and a mortise lock arrangement according to the present invention.

As may be seen in FIG. 2, lock box 20, which is usually formed of sturdy sheet metal, includes two vertical side walls 25 and 26, a top wall 27, a bottom wall 28, a rear wall (which cannot be seen in FIG. 2), and an open front end 29. Exposed at the top and bottom of the open front end are two walls 30 each having an internally threaded hole 31. While lock box 20 is shown as an independent unit in FIG. 2 for the sake of clarity, it is to be understood that in practice the lock box forms a permanent part of storm door 17, the lock box being welded to the other metal parts of the door.

Each wall 25 and 26 of lock box 20 is furnished with two holes 32 and 33 (only the holes in wall 26 being shown). The holes 32 and 33 are of equal size and each is large enough to allow a lock cylinder to pass through it. The holes 32 and 33 in each wall are vertically aligned, and the corresponding holes in the wall 25 and 26 are horizontally aligned.

With further reference to FIG. 2, the mortise lockset includes a conventional mortise lock 34 having a body 35 and a front plate 36 secured to the body by screws 37. Projecting slidably through the front plate 36 from body 35 are the usual deadbolt 38 and latch 39. Also exposed at front plate 36 is the usual two-position button 40 by means of which the latch can be locked, so as to be movable only by a key in the lock cylinder, or unlocked, so as to be movable by rotating the door knobs.

Lock body 35 is formed in each of its vertical side walls (only one being shown in FIG. 2) with an internally threaded hole 43 adapted to threadably receive an externally threaded lock cylinder. Thus, as shown in FIG. 2, hole 43 is adapted to receive lock cylinder 22, and the corresponding hole (not shown) in the other vertical side wall of lock body 35 is adapted to threadably receive lock cylinder 44. As usual, when the lock cylinders 22 and 44 are assembled with lock body 35, a key inserted into either lock cylinder can be used to operate the dead bolt 38 and latch 39.

Lock body 35 also includes a hole 45, having a square cross-sectional shape, for receiving similarly-shaped door knob spindles, and two holes 46 for receiving the mounting posts of a rosette.

Mortise lock 34 is assembled with lock box 20 by inserting lock body 35 into the open end 29 of the lock box and sliding the lock inwardly until the front plate 36 engages the walls 30. The lock is fixed in place by screws (not shown) which pass through holes 47 in front plate 36 and threadably engage holes 31 in the walls 30. If lock 34 is inserted into lock box 20 in the orientation shown in FIG. 2, holes 43 in the lock walls register with holes 32 in the walls 25 and 26 of the lock box. In addition, spindle hole 45 and one of the post holes 46 in the lock body 35 are exposed through the holes 33 in the walls 25 and 26, as indicated in broken lines in FIG. 2. It should be noted, however, that the other hole 46, indicated in dotted lines, is not exposed through hole 33, but rather is obstructed by the walls 25 and 26.

The mortise lockset also includes a plate 49 and a plate 50 for mounting against the external surfaces of lock box walls 25 and 26. Plate 49 carries, near one of its ends, door knob 21, which is rotatable with respect to the plate and projects outwardly therefrom. Fixed to door knob 21 is a spindle 51 having a square cross-sectional shape adapted to fit into hole 45 of the lock. Just below spindle 51, a mounting post 52 is fixed to and projects inwardly from plate 49. Post 52 is adapted to pass through hole 46 in lock body 35. The free end of mounting post 52 is provided with an internally threaded hole (not shown). At the end of plate 49 opposite the end which carries door knob 21, the plate is formed with a collar 53 defining a hole 54 sized to accommodate lock cylinder 22. The spacing between the center of hole 54 and the axis of spindle 51 is equal to the spacing between the center of hole 43 and the center of hole 45 which is also equal to the spacing between the centers of holes 32 and 33. Thus, when lock 35 is within lock box 20, plate 49 can be assembled with lock box wall 26 by inserting door knob spindle 51 and mounting post 52 into holes 45 and 46, respectively. Hole 54 in plate 49 will be aligned with hole 32 in the lock box wall and hole 43 in the lock. Lock cylinder 22, carrying the usual security washers 55 is then inserted through holes 54 and 32, and screwed into hole 43 of the lock.

Plate 50 carries at one end a door knob 58, the knob being rotatable with respect to, and projecting outwardly from, the plate. A spindle 59, having a square cross-sectional shape, is fixed to the knob 58 and projects inwardly from plate 50. Near spindle 59, plate 50 is formed with a hole 60 which is aligned with the lower hole 46 in lock body 35 when spindle 59 is inserted into hole 45. A bolt 61 can pass through hole 60 and be threaded into the hole in the free end of mounting post 52.

At its end opposite the end carrying door knob 58, plate 50 is formed with a collar 62 defining a hole 63 sized to accommodate lock cylinder 44. As with plate 49, the distance between the center of hole 63 and the axis of spindle 59 equals the spacing between the centers of holes 43 and 45. Thus, when lock body 35 is within lock box 20, spindle 59 can be inserted into hole 45, and hole 63 will be aligned with hole 32 in wall 25 and hole 43 in the lock. Bolt 61 is passed through hole 60 and threaded into mounting post 52. Lock cylinder 44, carrying security washers 64 passes through hole 63 and is threaded into the hole in the side wall of lock body 35 corresponding to hole 43.

Figure 4:
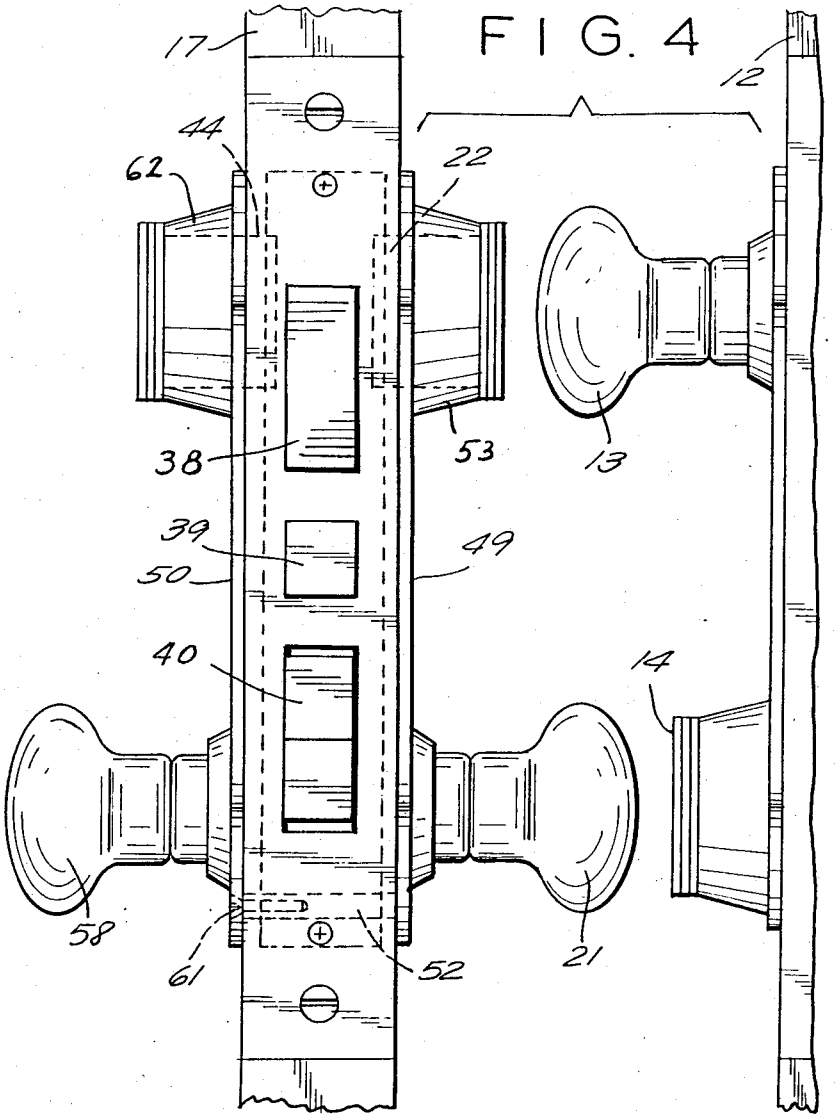
FIG. 4 is a view similar to FIG. 3 showing the knobs of the storm door below the knob of the main door.
Figure 3:
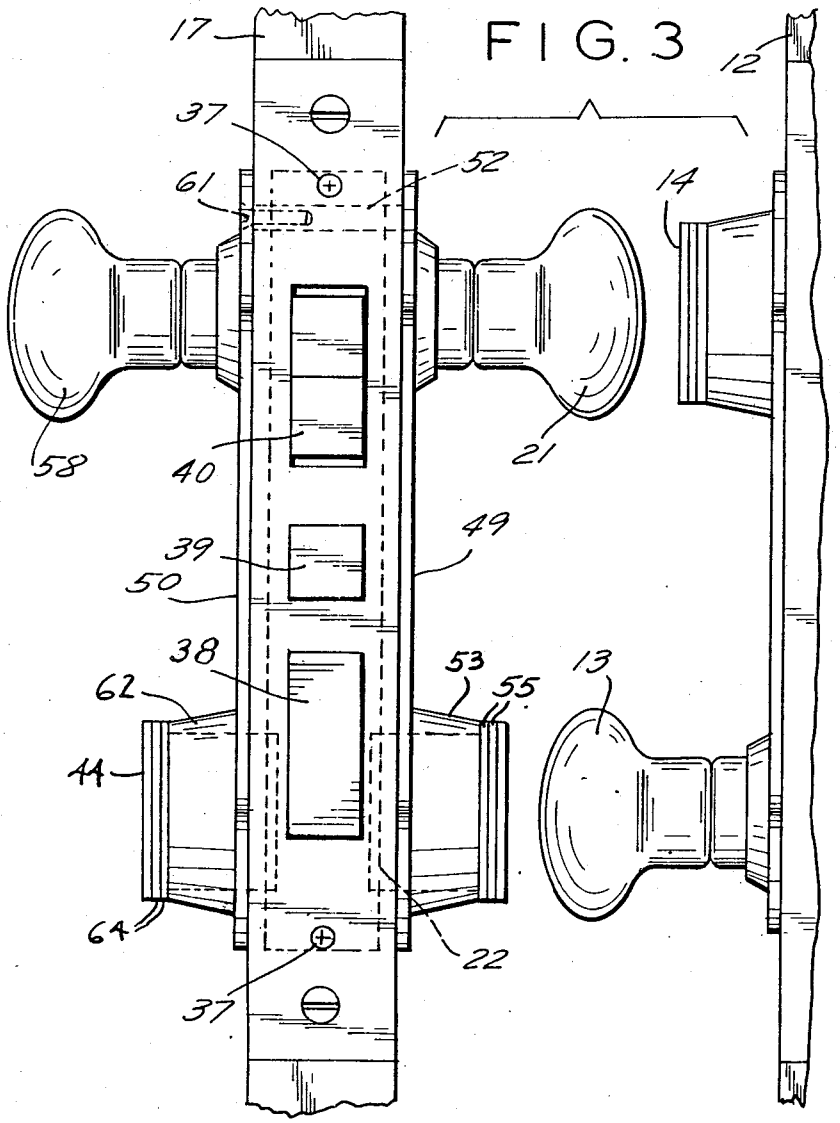
FIG. 3 is a fragmentary edge view of the main and security storm doors showing the knobs of the storm door above the knob of the main door.

As may be seen in FIG. 2, each lock cylinder 22 and 44 (which may be identical to each other) includes a peripheral lip **22*a* and 44*a*, respectively. When the parts are assembled, as shown in FIGS. 3 and 4, washers 55 are sandwiched between lip 22*a* and the exposed edge 53*a* of collar 53, and washers 64 are sandwiched between lip 44*a* and the exposed edge 62*a* of collar 62. As a result, when lock cylinder 22 is threaded into hole 43 in lock body 35 it serves to secure plate 49 to lock box 20 and lock body 35. Similarly, when lock cylinder 44 is threaded into lock body 35 it serves to secure the upper end of plate 50 to lock box 20 and lock body 35**.

It will be appreciated, therefore, that when the mortise lockset of the present invention is assembled with the lock box 20 of a security storm door 17, mounting post 52 and bolt 61 serve to firmly secure the lower ends of plates 49 and 50 to the lock box 20 and mortise lock 35, and the lock cylinders 22 and 44 serve to secure the upper ends of plates 49 and 50, respectively, to the lock box 20 and lock body 35. This secure mounting of plates 49 and 50 is accomplished even though only a single "through bolt" mounting 52, 61 is employed, because the lock cylinders 22 and 44 serve, in effect, as a second bolting of each plate to the lock box and lock body. Since no second through bolt is required, the second hole 46 in lock body 35, which is covered by the lock box walls 25 and 26, need not be used, and hence the lock box walls need not be drilled to provide access to that second hole 46.

When the parts are assembled in the orientation illustrated in FIG. 2, the door knobs 21 and 58 are located below the lock cylinders 22 and 44, as shown in FIG. 4. If there is no interference with the door knob 13 of the main door 12, as shown in FIG. 4, no change need be made. However, if door knob 13 were located in a lower position, as illustrated in FIG. 3, door knob 21 would interfere with it and prevent closing of the storm door 17. In such a case, lock 34 is reversed, i.e., rotated 180° about a horizontal axis from its orientation shown in FIG. 2, so that hole 43 would be below holes 45 and 46. Upon insertion of the lock into lock box 20, hole 43 would then register with holes 33 in lock box 20, and hole 45 and one of the two holes 46 would be exposed through holes 32 in the lock box. Plates 49 and 50 would also be reversed so that door knobs 21 and 58 are above collars 53 and 62, respectively. The parts are then assembled in precisely the same way as described above, to provide the assembly shown in FIG. 3. Because of the reversability of the lock set, door knobs 58 and 21 can always be mounted so as not to interfere with the door knob 13 of the main door.

In the description set forth above, and in the drawings, the door knobs 21 and 58 are shown mounted on the plates 49 and 50, respectively. In some cases, the door knobs and door knob spindles are provided as elements separate from the plates, and the plates are provided with holes into which the door knobs can be inserted. In these cases, after the plates 49 and 50 are mounted, by means of mounting post 52 and bolt 61 and lock cylinders 22 and 44, the door knobs are then assembled with the plates. Thus, the invention is equally applicable to situations in which door knobs are preassembled with the plates, or mounted after the plates are secured to the door.

In addition, mounting post 52 could be eliminated and in its place plate 49 formed with a hole similar to hole 60 in plate 50. A long threaded mounting bolt could then be inserted through that hole in plate 49, and through holes 46 and 60, and a nut fastened on the end of the bolt which projects beyond plate 50. In such a case, the mounting bolt and the nut would secure one end of each plate instead of post 52 and bolt 61.

It should also be mentioned that when mortise lock 34 is to be reversed from its position shown in FIG. 2, latch 39 must also be reversed. This is done by opening the lock and turning the latch around so that its orientation remains the same even though the lock has been reversed.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. In combination with a metal door furnished with a lock box having two opposed vertical walls, each wall of the lock box having two vertically aligned holes of equal diameter, each hole being horizontally aligned with a similar hole in the other lock box wall, a reversible mortise lockset comprising:

a mortise lock having an internally threaded lock cylinder hole about equal in diameter to each of the holes in the lock box wall, a door knob spindle hole, and a through bolt hole, the mortise lock being insertable into the lock box in either of two orientations, in one of the orientations the lock cylinder hole being aligned with the upper hole in each lock box wall and the door knob spindle hole and through bolt hole being exposed through the lower hole in each lock box wall, and in the other of the orientations the lock cylinder hole being aligned with the lower hole in each lock box wall and the door knob spindle hole and through bolt hole being exposed through the upper hole in each lock box wall, a pair of plates, one for mounting on the exterior surface of each of the lock box walls, each plate being adapted to accommodate a door knob and spindle near one of its ends so that the door knob projects outwardly from the plate and the door knob spindle projects inwardly therefrom for insertion into the door knob spindle hole in the mortise lock, a single mounting means projecting inwardly from one of the plates for insertion into the through bolt hole in the mortise lock, a cooperable mounting element for securing the other plate to the mounting means, the mounting means and mounting elements securing one end of each plate to the lock box and mortise lock, a lock cylinder hole near the end of each plate opposite the end carrying the mounting means, the lock cylinder hole in the mortise lock plate registering with the lock cylinder hole in the mortise lock and with a hole in the lock box wall adjacent to the plate when the mounting means is located within its respective hole, and an externally threaded lock cylinder passing through the lock cylinder hole in each plate and through the hole in the lock box wall in registry with the hole in the plate, and the lock cylinder being threaded into the lock cylinder hole in the mortise lock, so as to fasten the other end of each plate to the lock box and mortise lock, whereby the mortise lockset can be assembled with the lock box so that the door knobs are either above or below the lock cylinders depending upon which of the two orientations are chosen for insertion of the mortise lock into the lock box.

2. A mortise lockset as defined in claim 1 wherein the single mounting means is an internally threaded mounting post, and the cooperable mounting element is a bolt which can be threadably accommodated by the mounting post.

3. A mortise lockset as defined in claim 1 wherein the mortise lock has two through bolt holes, one through bolt hole being above the door knob spindle hole and the other through bolt hole being below the door knob spindle hole, and said one of the plates having a single mounting means for accommodation within only one of the through bolt holes, the other through bolt hole remaining empty when the mortise lockset is completely assembled with the lock box.

4. A mortise lockset as defined in claim 3 wherein only one of the two through bolt holes is exposed through one of the holes in each of the lock box walls after the mortise lock is inserted into the lock box, the other of the through bolt holes being hidden by a solid portion of each lock box wall.

5. In combination with a metal door furnished with a lock box having two opposed vertical walls, each wall of the lock box having two vertically aligned holes of equal diameter, each hole being horizontally aligned with a similar hole in the other lock box well, a reversible mortise lockset comprising:

a mortise lock having an internally threaded lock cylinder hole about equal in diameter to each of the holes in the lock box wall, a door knob spindle hole, and a through bolt hole, the mortise lock being insertable into the lock box in either of two orientations, in one of the orintations the lock cylinder hole being aligned with the upper hole in each lock box wall and the door knob spindle hole and through bolt hole being exposed through the lower hole in each lock box wall, and in the other of the orientations the lock cylinder hole being aligned with the lower hole in each lock box wall and the door knob spindle hole and through bolt hole being exposed through the upper hole in each lock box wall, a pair of plates, one for mounting on the exterior surface of each of the lock box walls, each plate being adapted to accommodate a door knob and spindle near one of its ends so that the door knob projects outwardly from the plate and the door knob spindle projects inwardly therefrom for insertion into the door knob spindle hole in the mortise lock, a spindle mounting means projecting inwardly from one of the plates for insertion into the through bolt hole in the mortise lock, a cooperable mounting element for securing the other plate to the mounting means, the mounting means and mounting element securing one end of each plate to the lock box and mortise lock, a lock cylinder hole near the end of each plate opposite the end carrying the mounting means, the lock cylinder hole in the mortise lock plate registering with the lock cylinder hole in the mortise lock and with a hole in the lock box wall adajcent to the plate when the mounting means is located within its respective hole, and an externally threaded lock cylinder passing through the lock cylinder hole in at least one of the plates and through the hole in the lock box wall in registry with the hole in the plate, and the lock cylinder being threaded to the lock cylinder hole in the mortise lock so as to fasten the other end of that plate to the lock box and mortise lock, whereby the mortise lockset can be assembled with the lock box so that the door knobs are either above or below the lock cylinders depending upon which of the two orientations are chosen for insertion of the mortise lock into the lock box.

6. A mortise lockset as defined in claim 5 wherein the mortise lock has two through bolt holes, one through bolt hole being above the door knob spindle hole and the other through bolt hole being below the door knob spindle hole, and said one of the plates having a single mounting means for accommodation within only one of the through bolt holes, the other through bolt hole remaining empty when the mortise lockset is completely assembled with the lock box.

7. A mortise lockset as defined in claim 6 wherein only one of the two through bolt holes is exposed through one of the holes in each of the lock box walls after the mortise lock is inserted into the lock box, the other of the through bolt holes being hidden by a solid portion of each lock box wall.

* * * * *